US007248707B2

(12) United States Patent
Peng et al.

(10) Patent No.: US 7,248,707 B2
(45) Date of Patent: Jul. 24, 2007

(54) DETECTION CIRCUIT

(75) Inventors: Yu-Chun Peng, Taipei (TW); Ching-Sung Ho, Taoyuan County (TW); Su-Hong Tseng, Taipei (TW); Hsi-Cheng Yeh, Taoyuan (TW)

(73) Assignee: High Tech Computer Corp., Taoyuan (TW)

( * ) Notice: Subject to any disclaimer, the term of this patent is extended or adjusted under 35 U.S.C. 154(b) by 747 days.

(21) Appl. No.: 10/629,863

(22) Filed: Jul. 30, 2003

(65) Prior Publication Data

US 2005/0090141 A1 Apr. 28, 2005

(30) Foreign Application Priority Data

Jan. 28, 2003 (TW) ..... 92101795 A

(51) Int. Cl.
*H04R 1/10* (2006.01)

(52) U.S. Cl. ..... 381/74

(58) Field of Classification Search ..... 381/74
See application file for complete search history.

(56) References Cited

U.S. PATENT DOCUMENTS 6,069,960 A * 5/2000 Mizukami et al. ..... 381/74
6,397,087 B1 * 5/2002 Kim et al. ..... 455/569.1
6,856,046 B1 * 2/2005 Scarlett et al. ..... 307/125
6,891,942 B1 * 5/2005 Porter et al. ..... 379/211.02
6,922,572 B2 * 7/2005 Lim ..... 455/570

* cited by examiner

*Primary Examiner*—Brian Tyrone Pendleton
(74) *Attorney, Agent, or Firm*—Birch, Stewart, Kolasch & Birch, LLP

(57) ABSTRACT

A plug detection circuit. The detected circuit is disposed in an electronics device with an earphone jack, accepting plugs with a plurality of conductive rings. The detection circuit has a plurality of pins, wherein a first pin detects, and outputs a first logic potential, and a second pin detects the potentials at the conductive rings and outputs a second logic potential. The detection circuit determines the type of earphone connected to the earphone jack.

4 Claims, 2 Drawing Sheets

| GPIO1 | GPIO2 | result |
|---|---|---|
| L | L | no earphone |
| H | H | typical earphone |
| H | L | earphone with microphone |

DETECTION CIRCUIT

This nonprovisional application claims priority under 35 U.S.C. §119(a) on Patent Application No(s). 92101795 filed in TAIWAN, R.O.C. on Jan. 28, 2003, which is (are) herein incorporated by reference.

BACKGROUND OF THE INVENTION

1. Field of the Invention

The present invention relates to a detection circuit, and more particularly, to a plug detection circuit detecting the type of earphone connected.

2. Description of the Related Art

Normally, earphones used with personal stereos are restricted to output only, but those used with cell phones can integrate microphone function. In both cases, the earphones can implement a three-wire structure. For use with a combination cell phone/PDA, however, three-wire structure is insufficient. Thus, combination cell phone/PDA units normally employ four-wire plugs. However, four-wire plugs have poor compatibility with other devices and higher cost.

Therefore, there is a need for an earphone jack that can detect the type of earphone connected that enables use thereof, irrespective of type.

SUMMARY OF THE INVENTION

An object of the present invention is to provide an earphone jack that can detect the type of earphone connected.

According to the above mentioned object, the present invention provides a plug detection circuit for detecting the type of earphone connected. The earphone plug has plural conductive rings. In the present invention, plug detection circuit has at least one first pin and one second pin. The first pin detects whether an earphone is connected to the earphone jack, and outputs a first logic potential. The second pin detects the potential at the conductive ring of the earphone plug, and outputs a second logic potential. Plug detection circuit determines the type of earphone connected according to the first logic potential and the second logic potential.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION OF THE INVENTION

Figure 1:
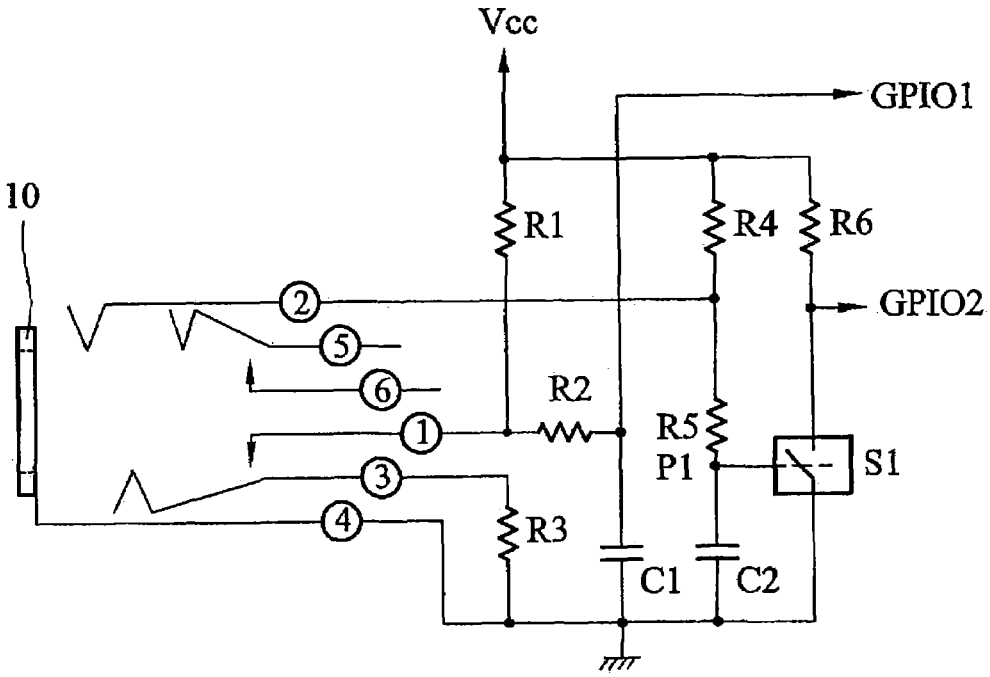
FIG. 1 is an equivalent diagram of a plug detection circuit with no earphone plug connected.

FIG. 1 is an equivalent diagram of plug detection circuit according to the invention with no plug connected. As shown in FIG. 1, plug detection circuit of the present invention includes resistors R1, R2, R3, R4, R5, R6, capacitors C1 and C2, and a switch S1. The earphone jack has six pins 1–6, wherein the grounding ring 10 is electrically coupled to pin 4. The resistor R1 is coupled between the voltage source Vcc and pin 1. The resistor R2 is coupled between pin 1 and the node GPIO1. The resistor R3 is coupled between pin 3 and ground. In this case, the potential at the node GPIO1 is defined as the first logic potential. Resistor R4 is coupled between the voltage source Vcc and pin 2. Resistor R5 is coupled between pin 2 and the node P1. Capacitor C2 is coupled between the node P1 and ground. Resistor R6 is coupled between the voltage source Vcc and the node GPIO2. The potential at the node GPIO2 of the resistor R6 and switch S1 is defined as the second logic potential. Switch S1 is coupled to the resistors R5 and R6 and ground. In this case, switch S1 is a MOS transistor having a gate coupled to the resistor R5 at node P1. Pin 5 and pin 6 are coupled together and pin 3 and pin 1 are coupled together when no plug is connected to the jack. At this time, the potential at node GPIO1 is a divided-voltage produced by the resistors R1 and R3. A low pass filter consists of the resistor R2 and the capacitor C1. The potential at node GPIO1 is regarded as low when the resistance of the resistor R1 exceeds that of the resistor R3. The voltage source Vcc charges the capacitor C2 through the resistors R4 and R5. Finally, the potential at node P1 is increased to voltage source Vcc to turn on switch S1, with the potential at node GPIO2 also low.

Figure 2:
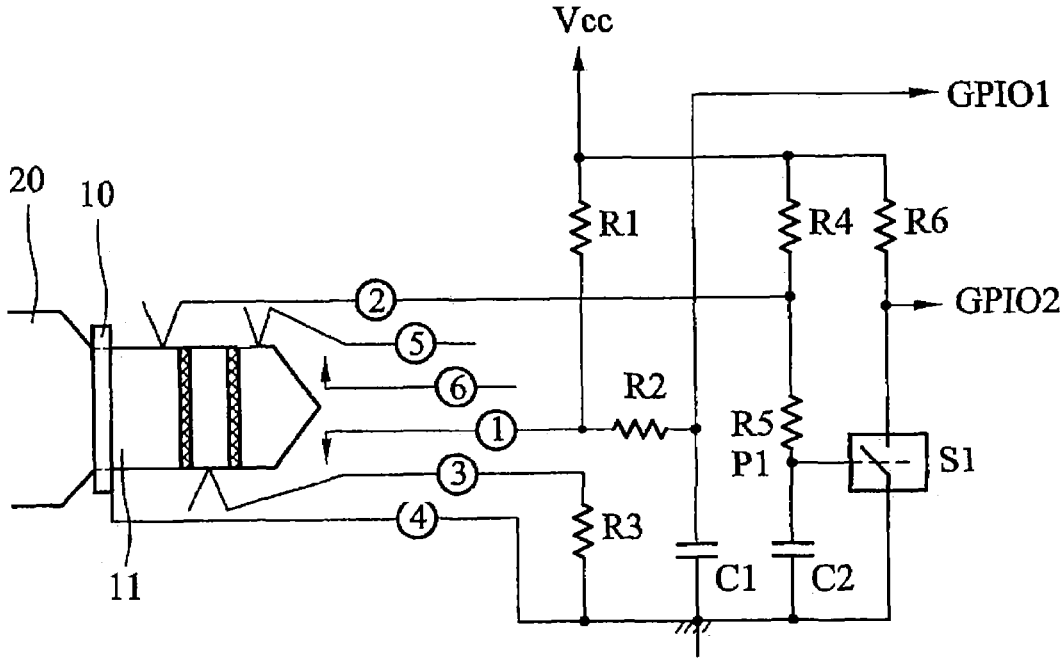
FIG. 2 is an equivalent diagram of plug detection circuit with a typical earphone plug connected.

FIG. 2 is an equivalent diagram of plug detection circuit according to the invention with plug 20 of a typical earphone connected. Plug 20 of a typical earphone is a three-wire plug having a first conductive ring 11, as shown in FIG. 2. When plug 20 of the typical earphone is connected to the earphone jack, the first conductive ring 11 of plug 20 is coupled to ground, pin 2 is coupled to pin 4 through the first conductive ring 11 of plug 20 and ground ring 10. Thus, pin 2 is grounded, and potential at node P1 grounded. Further, switch S1 is turned off, and the potential at node GPIO2 is high. In addition, pin 1 is separated from pin 3, and pin 5 is separated from pin 6 by insertion of plug 20. The voltage source Vcc charges capacitor C2 through the resistor R1 and R2. Finally, the capacitor C2 is charged to the voltage source Vcc, and the potential at node GPIO1 is high. Therefore, the potentials at nodes GPIO1 and GPIO2 of the detection circuit are both high only when plug 20 of a typical earphone is connected to the earphone jack.

Figures 3, 4:
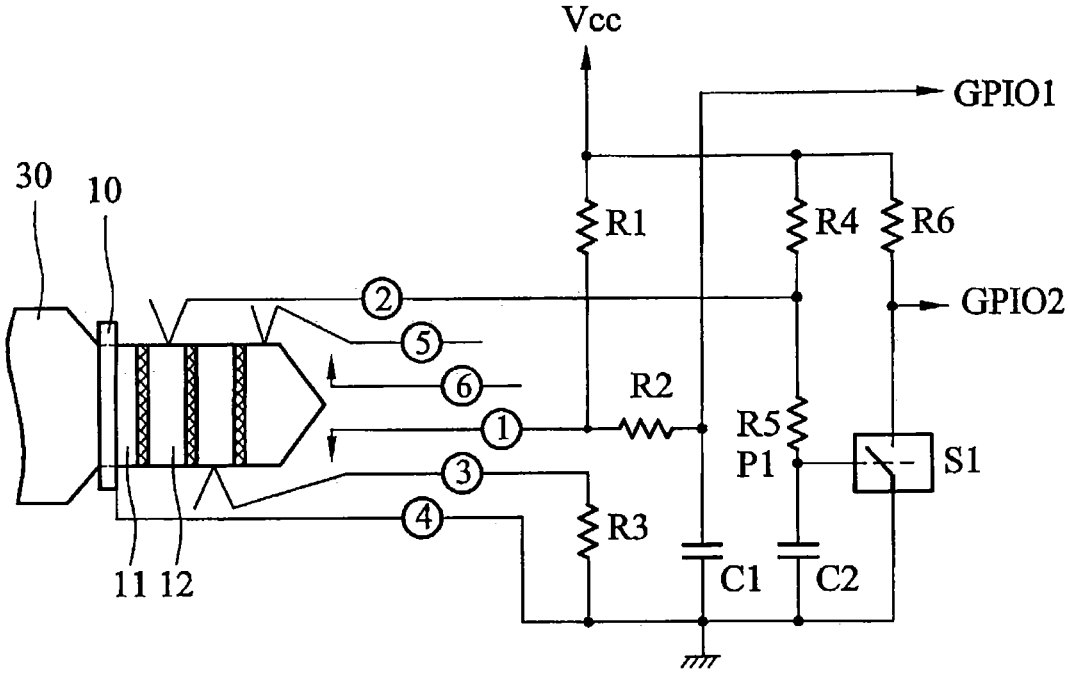
FIG. 3 is an equivalent diagram of plug detection circuit with an earphone plug with microphone function connected.
FIG. 4 shows the relationship between the detection result, the first logic potential and the second logic potential.

FIG. 3 is an equivalent diagram of plug detection circuit according to the invention with earphone plug 30 having microphone function connected. Plug 30 with microphone function and plug 20 of the typical earphone shown in FIG. 2 is that plug 30 not only has a first conductive ring 11 but also a second conductive ring 12. When plug 30 is connected to the earphone jack, the resistor R4 is coupled to the second conductive ring 12, the potential at node P1 is a divided-voltage produced by the resistors R4 and input impendence of the second conductive ring 12. A low pass filter consists of the resistor R5 and the capacitor C2, and the potential at node P1 is regarded as high if the input impendence of the second conductive ring 12 exceeds the resistance of the resistor R4. In addition, pin 1 is separated from pin 3, and pin 5 is separated from pin 6 due to the insertion by plug 30. At this time, the voltage source charges the capacitor C1 through the resistor R1 and R2. Finally, the potential across the capacitor is increased to the voltage source Vcc, and the potential at node GPIO1 is high.

FIG. 4 shows the relationship between the detection result, the first logic potential, and the second logic potential. As shown in FIG. 4, the potentials at nodes GPIO1 and GPIO2 are both low when no plug is connected to the earphone jack. The potentials at nodes GPIO1 and GPIO2 are both high when a plug of a typical earphone is connected to the earphone jack. In addition, the potentials at nodes GPIO1 and GPIO2 are high and low respectively when a plug of an earphone with microphone function is connected to the earphone jack.

Therefore, the present invention can detect whether a plug connected is of a typical earphone or a compound earphone with microphone function, according to the potentials at the nodes GPIO1 and GPIO2, and enable use of both types.

Although the present invention has been described in its preferred embodiments, it is not intended to limit the invention to the precise embodiments disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A plug detection circuit, disposed in a electronics device with an earphone jack, wherein the eat-phone jack has at least a first pin, a second pin and a third pin, the detection circuit comprising:

a first resistor electrically coupled to a voltage source and the first pin respectively;

a second resistor electrically coupled to the first pin;

a first capacitor having one end electrically coupled to a first output terminal with the second resistor, and the other end coupled to ground, wherein the potential at the first output terminal is a first logic potential;

a third resistor having one end electrically coupled to the third pin;

a fourth resistor electrically coupled to the voltage source and the second pin respectively;

a fifth resistor having one end electrically coupled to the second pin;

a second capacitor having one end electrically coupled to the fifth resistor, and the other end coupled to ground;

a sixth resistor having one end electrically coupled to the voltage source; and a switch having one end electrically coupled to the sixth resistor, and the other end coupled to ground, wherein the switch further has a control terminal electrically coupled to a second output terminal with the second capacitor and the fifth resistor, and the potential at the second output terminal is a second logic potential.

2. The plug detection circuit as claimed in claim 1, wherein the first pin is electrically coupled to the third pin and the switch is turned on when no plug is connected to the earphone jack, and the first logic potential and the second logic potential are low.

3. The plug detection circuit as claimed in claim 1, wherein the plug connected is of a typical earphone with a first conductive ring and a grounding ring; the second pin, the first conductive ring and the ground ring are electrically coupled to ground together, the first pin is not electrically coupled to the third pin, and the switch is turned off when the plug is connected to the earphone jack; and the first logic potential and the second potential are both high.

4. The plug detection circuit as claimed in claim 1, wherein the plug connected to the earphone jack is of an earphone with microphone function and has a first conductive ring, a second conductive ring and a grounding ring; the first conductive ring is electrically coupled to the grounding ring, the second conductive ring is electrically coupled to the second pin, the first pin is not electrically coupled to the third pin, and the switch is turned on when the plug is connected to the earphone jack; and the first logic potential is high and the second potential is low.

* * * * *